US007220102B2

(12) United States Patent
Cho et al.

(10) Patent No.: US 7,220,102 B2
(45) Date of Patent: May 22, 2007

(54) GUIDE BLADE OF AXIAL-FLOW FAN SHROUD

(75) Inventors: Kyungseok Cho, Daejeon-si (KR); Seyoung Park, Daejeon-si (KR)

(73) Assignee: Halla Climate Control Corporation, Daejeon-Si (KR)

( * ) Notice: Subject to any disclaimer, the term of this patent is extended or adjusted under 35 U.S.C. 154(b) by 0 days.

(21) Appl. No.: 10/561,730

(22) PCT Filed: Jul. 1, 2004

(86) PCT No.: PCT/KR2004/001610

§ 371 (c)(1),
(2), (4) Date: Dec. 22, 2005

(87) PCT Pub. No.: WO2005/003569

PCT Pub. Date: Jan. 13, 2005

(65) Prior Publication Data

US 2006/0147304 A1 Jul. 6, 2006

(30) Foreign Application Priority Data

Jul. 1, 2003 (KR) ..... 10-2003-0044222

(51) Int. Cl.
*F04D 29/54* (2006.01)

(52) U.S. Cl. ..... 415/211.2; 415/220

(58) Field of Classification Search ..... 415/121.2, 415/208.2, 210.1, 211.2, 220, 222, 223; 416/189, 416/192, 247 R See application file for complete search history.

(56) References Cited

U.S. PATENT DOCUMENTS

| | | | | |
|---|---|---|---|---|
| 2,154,313 | A * | 4/1939 | Mcmahan | 415/210.1 |
| 4,548,548 | A | 10/1985 | Gray, III | |
| 4,927,324 | A * | 5/1990 | Coup et al. | 415/121.2 |
| 5,443,363 | A * | 8/1995 | Cho | 415/211.2 |
| 6,024,536 | A * | 2/2000 | Tsubakida et al. | 416/189 |
| 6,142,733 | A * | 11/2000 | Alizadeh et al. | 415/208.2 |
| 6,398,492 | B1 | 6/2002 | Cho et al. | |
| 6,572,333 | B2 * | 6/2003 | Fujinaka | 415/208.2 |

FOREIGN PATENT DOCUMENTS

| | | |
|---|---|---|
| JP | 02196197 A | 8/1990 |
| JP | 10-205497 A | 8/1998 |

* cited by examiner

*Primary Examiner*—Edward K. Look
*Assistant Examiner*—Nathan Wiehe
(74) *Attorney, Agent, or Firm*—Fulbright & Jaworski L.L.P.

(57) ABSTRACT

Guide blades of an axial flow fan shroud for guiding the air blown by an axial flow fan in an axial direction. A guide blade of an axial flow fan shroud has a leading edge for introducing the air blown by an axial flow fan including a plurality of blades; a trailing edge extended from the leading edge to downstream; and an air flow guide surface for guiding the blown air between the leading and trailing edges. A first outlet area a is defined by at a radius r from a root in the total length R of an angle of projection Aout of the guide blade and a second outlet area b is defined by the remainder, the angle of projection Aout increases as approaching a tip with respect to an axial line in the second outlet area b.

5 Claims, 9 Drawing Sheets

Prior Art

Prior Art

GUIDE BLADE OF AXIAL-FLOW FAN SHROUD

This is a §371 of PCT/KR2004/001610 filed Jul. 1, 2004, which claims priority from Korean Patent Application No. 10-2003-0044222 filed Jul. 1, 2003.

TECHNICAL FIELD

The present invention relates to guide blades of an axial flow fan shroud for guiding the air blown by an axial flow fan in an axial direction, and more particularly, to a guide blade structure capable of preventing high temperature heat generated by an engine room from flowing backward to a condenser.

BACKGROUND ART

An axial flow fan is an apparatus for rotating a number of radially arrayed blades to blow the air in an axial direction, and includes a shroud which serves to guide the air blew in by the axial flow fan directly backward.

The axial flow fan is used to ventilate a room or to feed the air into an air-cooled heat exchanger such as a radiator or condenser of an automobile in order to promote the heat dissipation thereof.

In the meantime, the shroud includes a number of strip-shaped and fixed guide blades which are arrayed radially from the central axis of the axial flow fan in order to raise the blowing efficiency of the axial flow fan. The guide blades converts the kinetic energy of the air blown from blades of the axial flow fan into pressure energy to raise static pressure thereby elevating axial blowing efficiency.

Hereinafter the structure of the axial flow fan will be described in more detail.

FIG. 1 illustrates a rear view of an axial flow shroud assembly adopted in a conventional condenser for an automobile.

As shown in FIG. 1, an axial flow fan 100 includes an annular fan hub 220 connected to a drive shaft 210 of a motor 200 and a number of blades 120 arrayed around and integrally with the fan hub 220. In the aspect of blowing efficiency, the axial flow fan 100 is typically installed in the rear of a condenser. Of course, the axial flow fan 100 may adopt a pusher type which is installed in front of the condenser in case that a sufficient installation space is not obtained in the rear of a heat exchanger within an engine room.

In the axial flow fan 100, the motor 200 turns the blades 120 in the rear of the condenser to blow in the air from the front of the heat exchanger through the heat exchanger to introduce the air rearward so that the air blew in by the axial flow fan 100 deprives the hot condenser of heat to cool the same. The axial flow fan 100 is generally made of synthetic resin, and integrally molded so that the fan hub 220 and the blades 120 are formed of a single body.

The shroud 300 functions to fix the axial flow fan 100 including the motor 200 with respect to the heat exchanger, and to introduce the air blew in by the axial flow fan 100 directly backward. The shroud 300 includes a substantially rectangular housing 310, a motor support ring 320 provided in the center of the housing 310 and a number of guide blades 330 arrayed substantially radially for supporting the motor support ring 320 with respect to the housing 310.

The guide blades 330 of the shroud 300 are connected to the motor support ring 320, and as shown in FIG. 1, obliquely inclined in the turning direction of the axial flow fan 100 to form air flow guide surfaces 332 of a predetermined area in order to vary the blown air in an axial direction to increase the quantity of the axially blown air.

That is, the guide blades 330 are straightly extended from the outer circumference of the motor support ring 320 toward the housing 310, and inclined at a predetermined angle $\theta_t$ with respect to the axial direction as shown in FIG. 2, as a schematic plan view of a single guide blade 330, so that the air flow guide surfaces 332 formed in the rear faces of the guide blades 330 can directly change the flowing direction of the air. As shown in the sectional view, the single guide blade 330 includes a leading edge 331 for introducing the air, a trailing edge 333 for exhausting the air to the outside and an air flowing guide face 332 connecting the leading edge 331 with the trailing edge 333.

The air flowing guide face 332 converts the rotation velocity component of the air into the axial direction to increase the axial velocity of the air thereby raising the blowing efficiency of the axial flow fan 100. That is, because the air blown by the axial flow fan 100 has not only an axial velocity component $U_z$ but also a rotational axial velocity component $U_{th}$, the rotational velocity component $U_{th}$ may lower the blowing efficiency if left alone. Thus, the rotational velocity component $U_{th}$ is converted into the axial direction to enhance the axial blowing velocity thereby raising the blowing efficiency of axial flow fan 100.

The operation of the air flow guide surface 332 of the each guide blade will be described in more detail with reference to FIG. 2. Since an air particle in a flow field spaced from the center of gyration at any distance has an axial velocity component $U_z$ and a rotational velocity component $U_{th}$ by the rotational force of the blade 320 with respect to the axial direction, the air particle is blown toward the leading edge 331 of the guide blade 330 in a direction inclined to a specific angle $\theta_T$ in a rotating direction with respect to an axial line A.L which is actually parallel with the axial direction. Regarding the actual blowing direction, the air flow guide surface 332 of the guide blade 330, in view of the section in a breadth direction, is designed into a curve inclined at an angle $\theta_t$ ($\theta_t \leqq \theta_T$) in the counter-rotating direction of the axial flow fan 100, that is, the air exhausting direction with respect to the axial line A.L. Then, the air flow guide surface 332 refracts the air blown by the axial flow fan 100 in the axial direction thereby to increase the axial velocity of the air. The increase in the axial velocity of the blown air means the enhancement of blowing efficiency. As a result, in the design of the guide blade 330, the air flow guide surface 332 which is inclined in the counter-rotating direction with respect to the axial direction serves to enhance the blowing efficiency of the axial flow fan.

Considering the actual blowing speed, several approaches which can enhance the blowing speed through the variation of the configuration of the guide blade 330 have been studied in various aspects.

U.S. Pat. No. 4,548,548 discloses an invention which substantially limits an inclination angle with respect to an axial line of an air flow guide surface of a guide blade to further enhance the blowing efficiency.

That is, at a point in a flow field that is spaced from the center of gyration at a distance r in a radial direction, a velocity vector of an air particle has an axial velocity component A and a rotational velocity component R by the blade-turning force of the axial flow fan. The velocity vector Ao has an inclination angle $T-Tan^{-1}(R/A)$ with respect to the axial line. Regarding the inclination angle, the guide blade is so arranged that the normal line of the central portion thereof is inclined at an angle T/2 with respect to the axial line, and the air flow guide surface is curved to have a substantially arc-shaped section. In this way, the air flow guide surface introduces the blown air at the inclination angle T/2 in the center, and then refracts the blown air for the inclination angle T/2 to the axial direction. As a consequence, the axial velocity of the air blown by the axial flow fan is increased in proportion with the rotational velocity component R which is converted into the axial direction. That is, the air flow guide surface of the guide blade enhances the quantity of the air blown by the flow fan in proportion with the rotational velocity component of the air particle that is converted into the axial direction.

In the meantime, the air blown by the axial flow fan has a radial velocity component $U_r$ by the centrifugal force of the axial flow fan in addition to the axial velocity component $U_z$ and the rotational velocity component $U_{th}$. An approach for converting the rotational velocity component $U_{th}$ and the radial velocity component $U_r$ into the axial velocity component $U_z$ to enhance the blowing efficiency is disclosed in U.S. Pat. No. 6,398,492 which was filed by the inventor of the present invention.

The guide blade of the present invention is arranged radially with respect to the central axis of the axial flow fan, and bent radially with respect to a radial line so that a leading edge line intersects perpendicularly with a lateral velocity vector $U_s$ that is the sum of the rotational velocity vector $U_{th}$ and the radial velocity vector $U_r$. Further, the angle of incidence of the guide blade is the same as an air inflow angle $\mathrm{Tan}^{-1}$ ($U_s/U_z$), that is the angle of the air introduced to the guide blade, and the angle of projection of the guide blade is curved at 0° with respect to the axial line.

The prior art as above can enable the use of a low power motor by enhancing the axial blowing efficiency in order to reduce the power consumption necessary for the air blowing as well as to restrain noises during the air blowing. However, since the angle of projection of the guide blade is 0° with respect to the axial line, the air passing through the axial flow fan is guided toward the engine in the rear in the axial direction of the fan colliding into the engine so that high temperature heat generated by the engine flows backward toward the heat exchanger such as a condenser to elevate the refrigerant pressure of the heat exchanger thereby disadvantageously degrading the performance of an air conditioning system.

DISCLOSURE OF THE INVENTION

The present invention has been devised to solve the foregoing problems occurring in the prior art, and it is therefore an object of the present invention to provide a guide blade of an axial flow fan shroud which converts both of rotational and radial velocity components of the air blown by an axial fan into an axial direction to spread in radial and rotational directions to enhance the blowing efficiency in the axial direction as well as to prevent high temperature heat generated by an engine room from flowing backward to a heat exchanger such as a condenser thereby improving the performance of an air conditioning system.

According to an aspect of the invention for realizing the object, there is provided a guide blade of an axial flow fan shroud comprising: a leading edge for introducing the air blown by an axial flow fan including a plurality of blades; a trailing edge extended from the leading edge to downstream; and an air flow guide surface for guiding the blown air between the leading and trailing edges, wherein the area from a root to a radius $r_a$ is defined as the first outlet area a; and the area from a radius $r_a$ to the radius R which is the total length guide blade 35 is defined as the second outlet area b; and the angle between the tangent line at the trailing edge and the axis of the axial flow fan is defined as the angle of projection Aout; and the angle of projection Aout increases as approaching a tip with respect to an axial line in the second outlet area b.

Preferably, the second outlet area b has a radial ratio $R_a/r$ in the range of about 0.4 to 1 with respect to the total length R of the guide blade 35, and the angle of projection Aout gradually increases from 0 to about 60°.

Preferably, a root to a radius $r_b$ is defined as the first inlet area A; and the area from a radius $r_b$ to the radius R which is the total length of guide blade 35 is defined as the second inlet area B; and the angle between the tangent line at the leading edge and the axis of the axial flow fan is defined as the angle of incidence Ain; and the second inlet area B has a radial ratio $r_b/R$ in the range of about 0.4 to 1 with respect to the total length R of the guide blade 35, and the angle of incidence Ain gradually increases up to about 90° in the second inlet area B.

Preferably, wherein Us is a lateral velocity vector of air t a point P and Uz is the axial velocity of component of air at the point P the air flow guide surface 38 is so curved that the angle of incidence Ain is the same as an air inflow angle $\mathrm{Tan}^{-1}$ (Us/Uz) in the first inlet area A, and the angle of projection Aout is 0° with respect to the axial line.

BEST MODE FOR CARRYING OUT THE INVENTION

Figure 1:
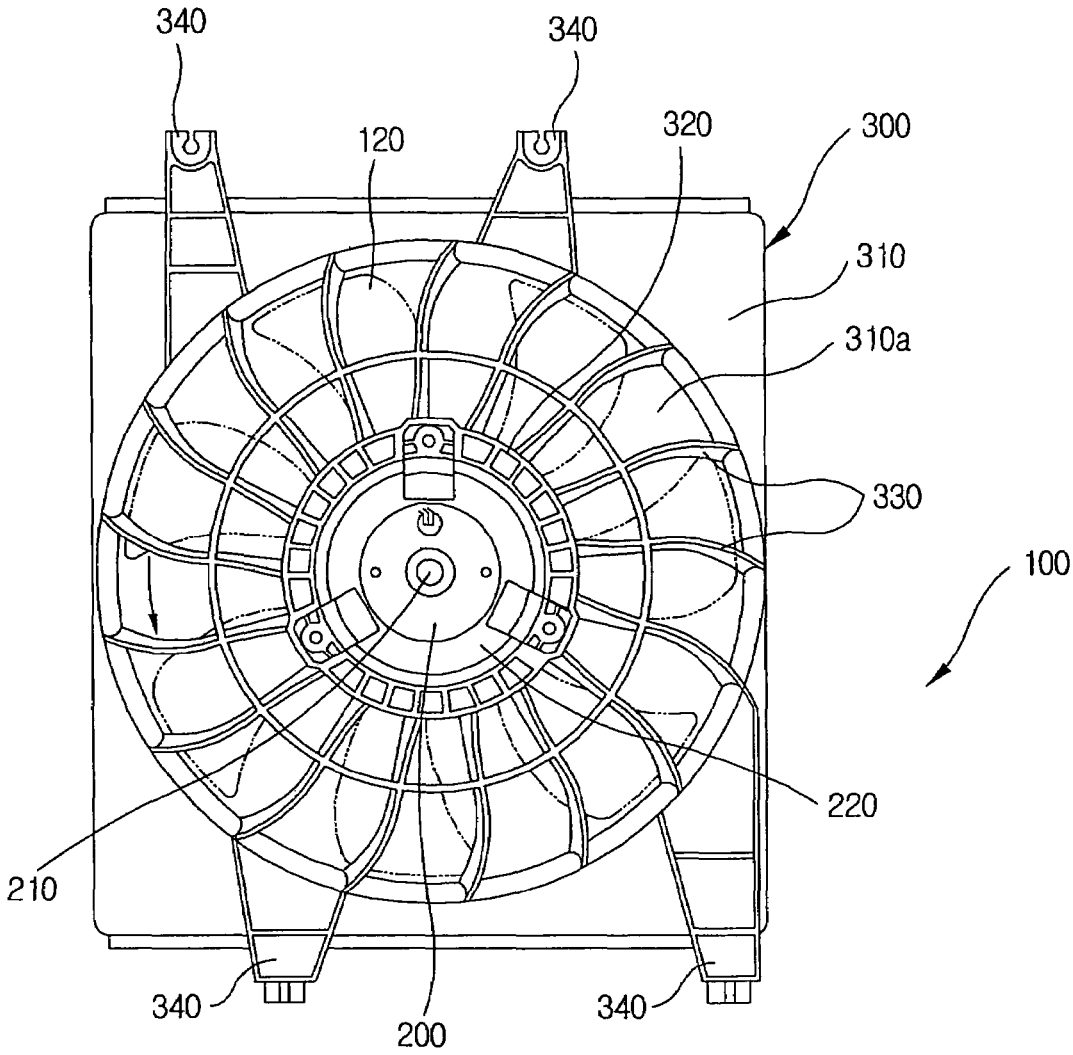
FIG. 1 is a rear view of a conventional axial flow fan shroud assembly.
Figure 2:
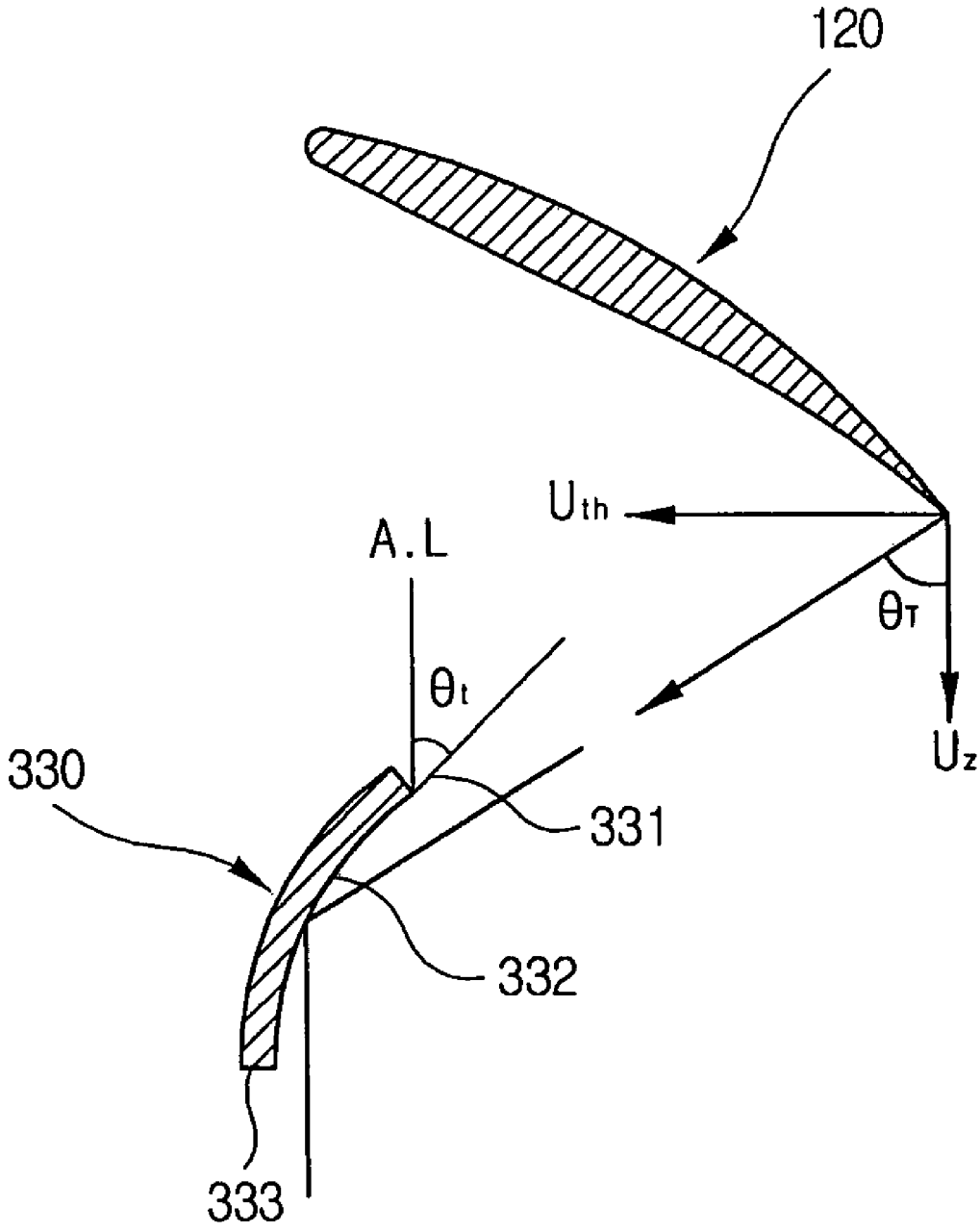
FIG. 2 is a schematic plan sectional view of a guide blade at a point spaced from the central axis in a conventional axial flow fan shroud assembly.

Hereinafter a preferred embodiment of the present invention will be described in detail with reference to the accompanying drawings.

The same or similar parts are designated with the same or similar reference numerals as in the prior art, and repeated description thereof will be omitted.

Figure 3:
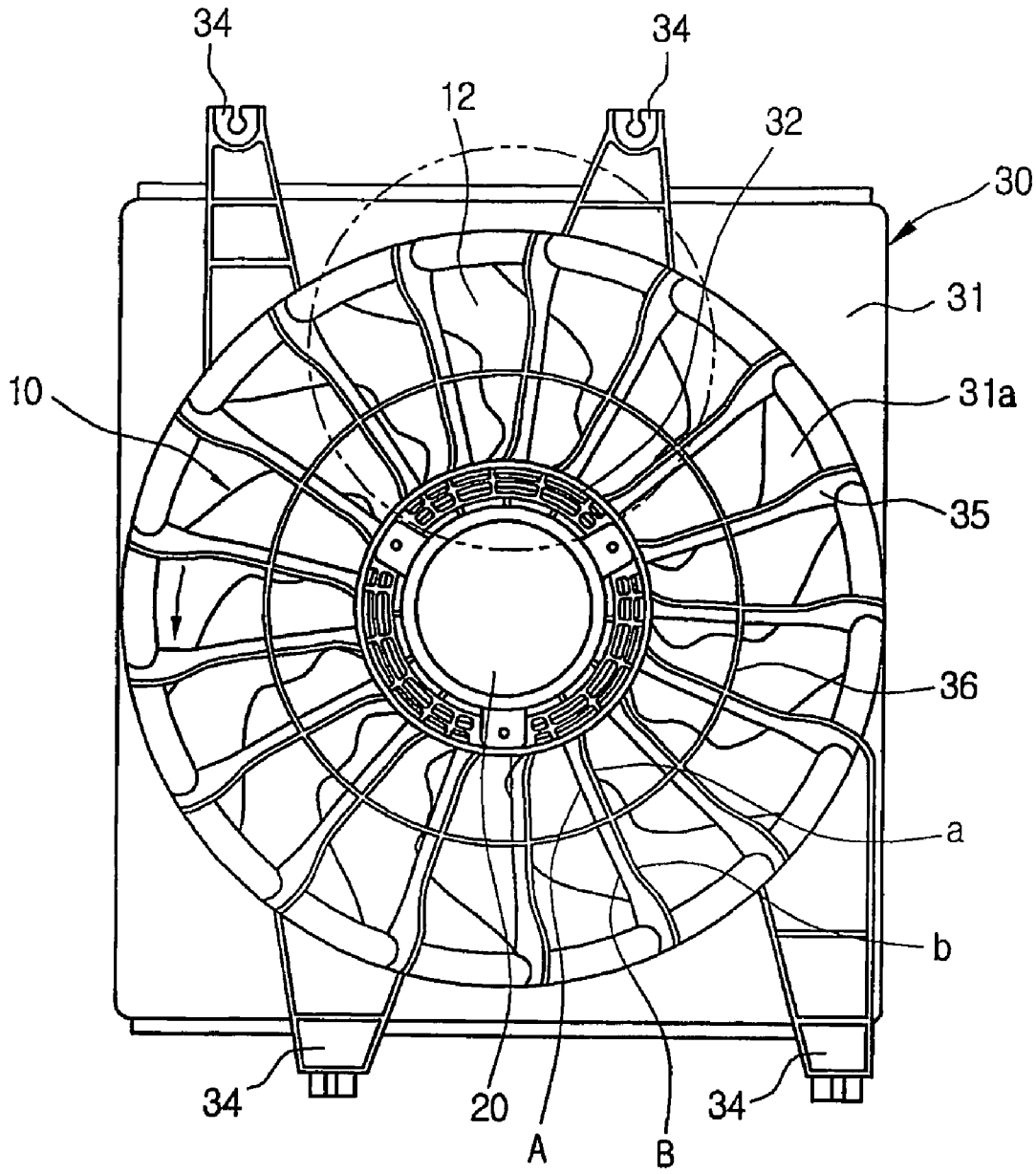
FIG. 3 is rear view of an axial flow fan shroud assembly of the present invention.
Figure 4:
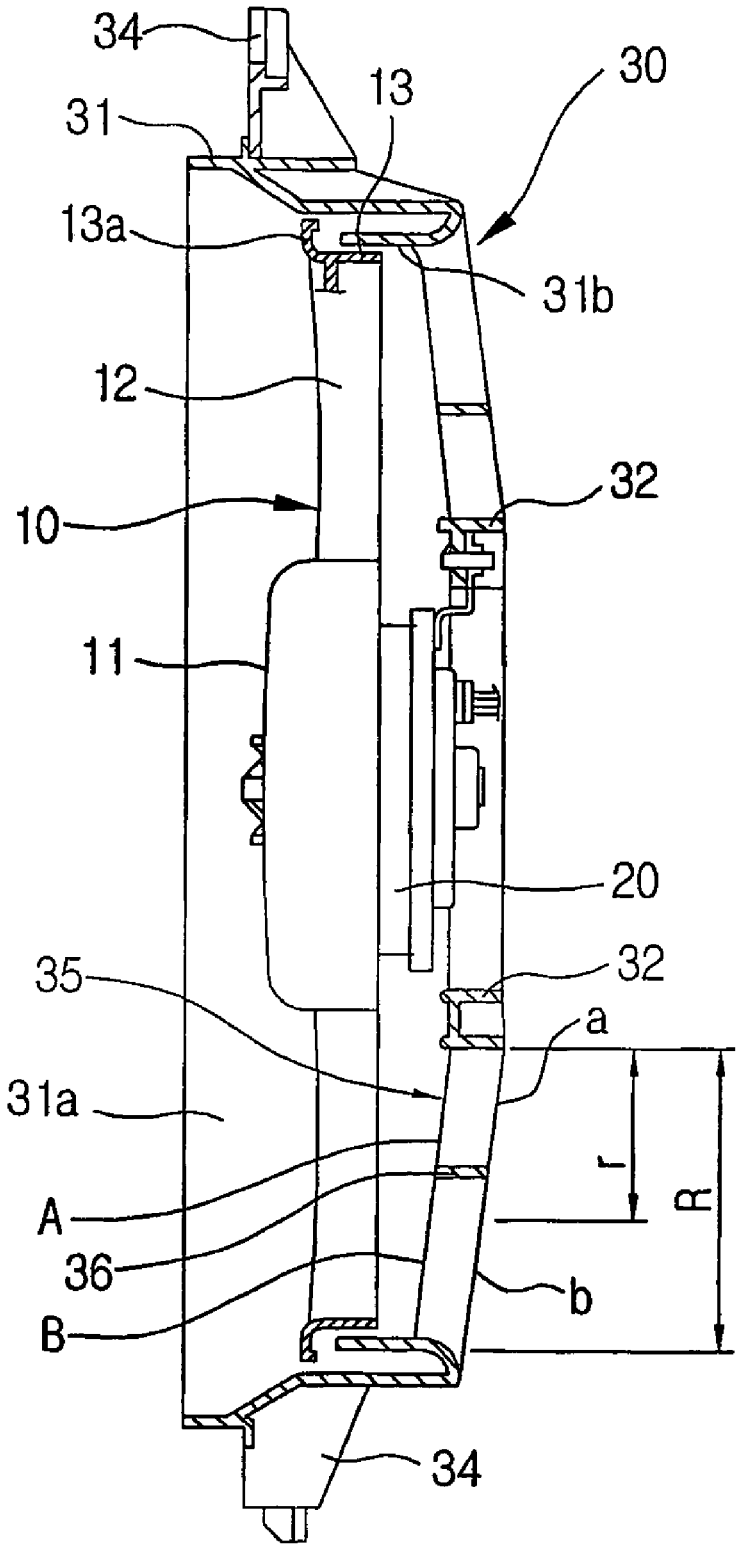
FIG. 4 is a side elevation view of the axial flow fan shroud assembly in FIG. 3.

FIGS. 3 and 4 illustrate an axial flow fan shroud assembly of the present invention, in which an axial flow fan 10 and a shroud 30 are assembled into an integral unit.

The axial flow fan 10 includes an annular fan hub 11 and a number of blades 12 arrayed along the outer circumference of the fan hub 11 at a predetermined gap. Shroud 30 includes a motor support ring 32, guide blades 35 and a housing 31.

As shown in FIG. 4, axial flow fan 10 is integrally provided with a fan band 13 which is coaxial with fan hub 11. Fan band 13 fixedly connects the ends of blades 12 to restrain a vortex at the ends of blades 12 thereby enhancing the blowing efficiency. Axial flow fan 10 is typically made of synthetic resin into a unitary form, but alternatively may be molded from light aluminum and so on.

In the meantime, the front end of fan band 13 of axial flow fan 10 is expanded into the form of a bell mouth and extended into a U-shaped configuration from the rear end of the housing 31 of shroud 30 to upstream to form an air introduction part 13*a* to surround the front end of an air guide part 31*b*.

In housing 31 of shroud 30, the front is rectangular shaped to span the entire rear part of the heat exchanger, and the periphery is projected to a predetermined height to ensure an air flow space between the rear part of the heat exchanger. Housing 31 is reduced to downstream to form a circular vent hole 31*a*, and has a side section shaped as a bell mouth which is widened to upstream and reduced to downstream.

Motor support ring 32 is arranged in the center of vent hole 31*a* of the housing 31 so that the axial flow fan 10 is fixed together with motor 20. Motor support ring 32 has an annular shape as fan hub 11 of axial flow fan 10 and motor 20.

As shown in FIG. 3, guide blades 35 are arrayed radially between motor support ring 32 and housing 31 to fixedly support motor support ring 32 with respect to housing 31 in the center of vent hole 31*a* and to introduce the three-dimensional air, which is blown from axial flow fan 10, into a one-dimensional direction in order to enhance the blowing efficiency of axial flow fan 10 as well as to restrict blowing noises.

Figure 5:
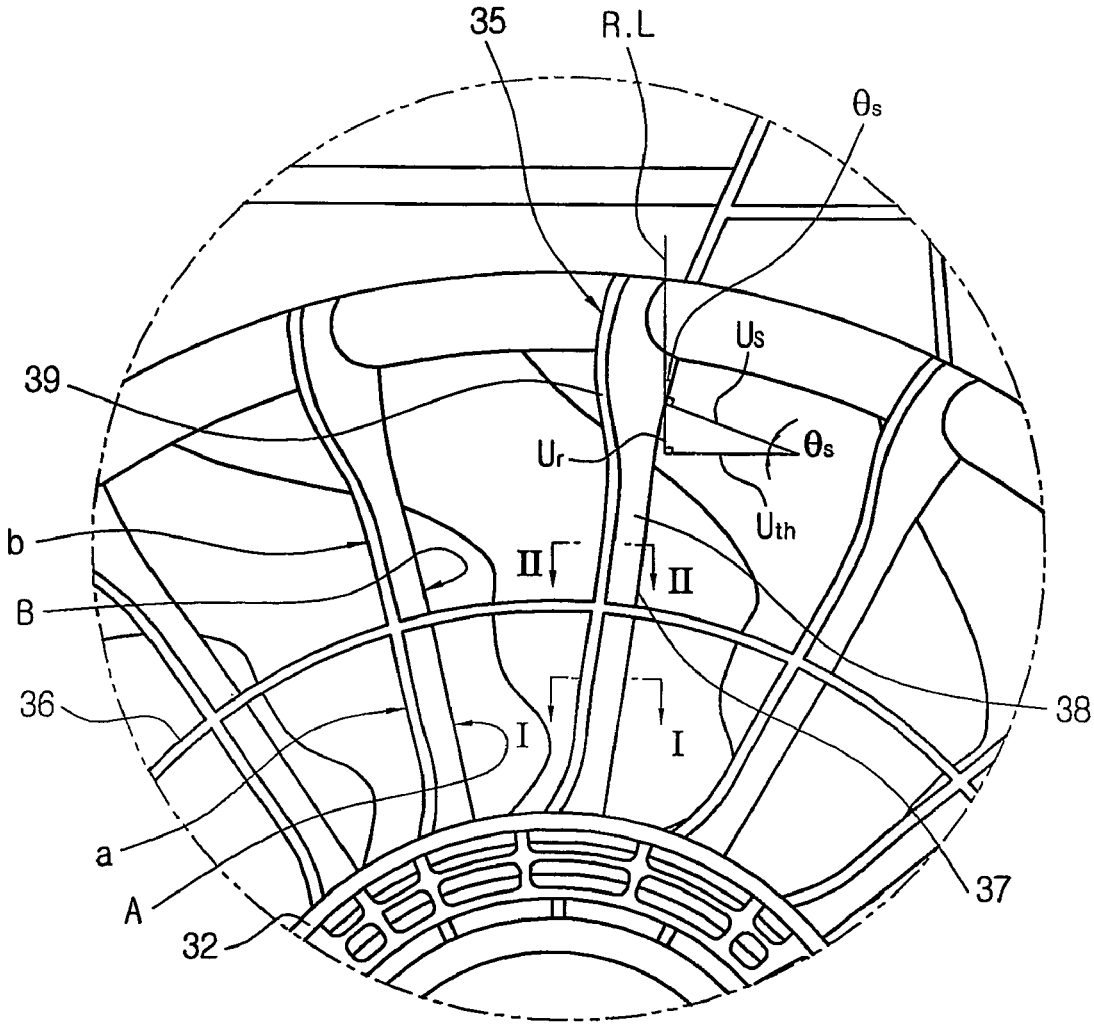
FIG. 5 is an enlargement of guide blades according to the present invention.

FIG. 5 illustrates the structure of the guide blades 35 in detail. Each of guide blades 35 forms an arc having a predetermined area defined by leading edge 37 placed in the leading end for introducing the air, an air flow guide surface 38 extended to downstream from leading edge 37 and trailing edge 39 placed in the rear end of air flow guide surface 38. Since the arc is curved and obliquely inclined with respect to an axial direction, the air blown by axial flow fan 10 can be efficiently refracted and introduced to air flow guide surface 38.

Further, each guide blade 35 of the present invention is radially curved so that axial flow fan 10 can efficiently receive and convert the three-dimensional air into the axial direction.

In the meantime, guide blades 35 are provided integrally with an auxiliary ring 36 formed by a radius $r_c$ from the root of the total length R of guide blade 35 and which connects and supports individual guide blades 35. Each of guide blades 35 is partitioned into a first inlet section A, a first outlet section a, a second inlet section B and a second outlet section b on the basis of the auxiliary ring 36.

Before determining the configuration of each guide blade 35 of the present invention, the velocity of the air blown by axial flow fan 10 will be analyzed as the most important factor for determining the configuration.

Figure 6:
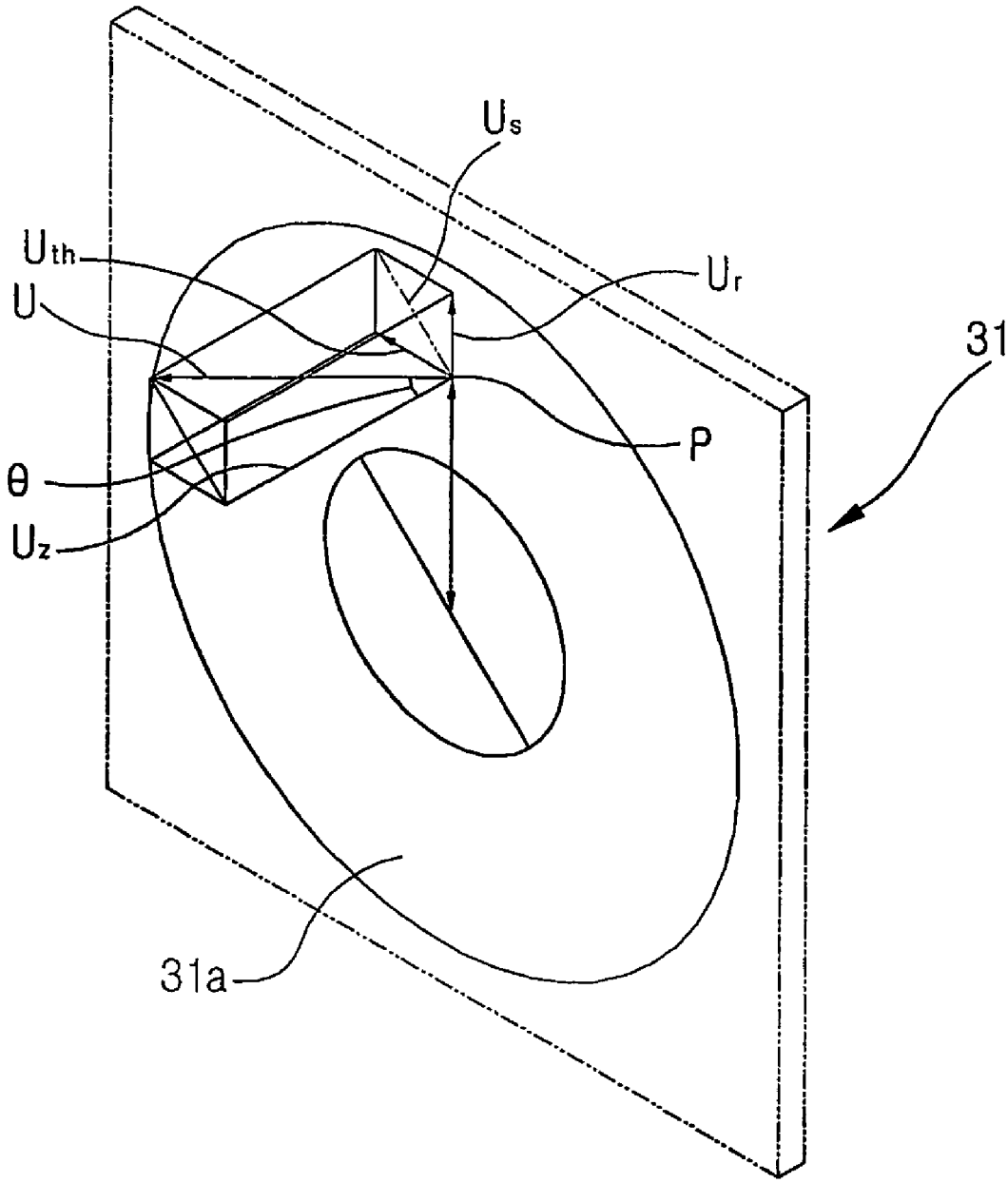
FIG. 6 illustrates velocity components at a point spaced from the central axis of the shroud according to the present invention.

FIG. 6 illustrates a velocity component of the air at a point P in vent hole 31*a* spaced from the center. The air blown by the axial flow fan flows with an axial velocity component $U_z$, a rotational velocity component $U_{th}$ and a radial velocity component $U_r$ by the centrifugal force of axial flow fan 10.

Since the air blown by axial flow fan 10 necessarily has the axial velocity component $U_z$, the rotational velocity component $U_{th}$ and a radial velocity component $U_r$, the actual velocity vector U of an air particle blown at the point P becomes the sum of the axial velocity component $U_z$, the rotational velocity component $U_{th}$ and the radial velocity component $U_r$ as shown in FIG. 6. In the velocity vector U of the air particle, a lateral velocity vector $U_s$ as the sum of the rotational velocity component $U_{th}$ and the radial velocity component $U_r$ is inclined at a specific angle θ with respect to an axial line in parallel with the rotation axis, wherein $\theta=\mathrm{Tan}^{-1}(Us/Uz)$. That is, the air particle blowing in the point P has the lateral velocity component $U_s$, and thus is biased to the rotational and radial directions of axial flow fan 10.

With respect to the actual velocity vector U of the air particle blown as above, the guide blade 36 is preferably required to a configuration to:

(1) introduce the lateral velocity vector $U_s$ as the sum of the rotational velocity component $U_{th}$ and the radial velocity component $U_r$ toward axial direction to enhance the blowing efficiency of the axial flow fan 10, and (2) spread the air in the rotational and radial directions when the air passes by guide blade 35 in order to prevent high temperature heat generated from an engine room from flowing back into the heat exchanger such as a condenser.

In order to meet demand as above, the present invention designs guide blade 35 as follows: According to the radial ratio r/R of guide blade 35, a portion adjacent to the center of the rotation axis introduces the lateral velocity vector $U_s$ as the sum of the rotational velocity component $U_{th}$ and the radial velocity component $U_r$ in the lateral direction to enhance the blowing efficiency of the axial flow fan 10. In a portion away from the center of the rotation axis, guide blade 35 spreads the air in the rotational and radial directions to prevent the collision of the air into an engine and resultant backflow thereof thereby enhancing the performance of an air conditioning system.

As a consequence, it is preferable to divide the guide blade 35 into two sections in order to realize guide blade 35 which satisfies above conditions.

In addition, for the sake of understanding, when a tangent line contacts leading and trailing edges 37 and 39 of guide blade 35, cross angles with respect to the axial line will be referred to as an angle of incidence Ain and an angle of projection Aout, respectively.

Where the area from a root to a radius $r_b$ is defined as the first inlet area A; and the area from a radius $r_b$ to the radius R which is the total length of guide blade 35 is defined as the second inlet area B; and the angle between the tangent line at the leading edge and the axis of the axial flow fan is defined as the angle of incidence Ain; and, the angle of incidence Ain preferably increases as approaching a tip from the second inlet area B with respect to the axial line.

In the first inlet area A, an r/R as a ratio of the radius r with respect to the total length R of the guide blade 35 preferably corresponds to about 0 to 0.4. In the second inlet area B, an r/R as a ratio of the radius r with respect to the total length R of the guide blade 35 preferably corresponds to about 0.4 to 1.

Further, the area from a root to a radius $r_a$ is defined as the first outlet area a; and the area from a radius $r_a$ to the radius A which is the total length of guide blade 35 is defined as the second outlet area b; and the angle between the tangent line at the trailing edge and the axis of the axial flow fan is defined as the angle of protection Aout; and, the angle of projection Aout preferably increases as approaching a tip from the second outlet area b with respect to the axial line.

In the first outlet area a, an r/R as a ratio of the radius r with respect to the total length R of guide blade 35 preferably corresponds to about 0 to 0.4. In the second outlet area b, the second outlet area b has a radical ratio $r_a/R$ in the range of about 0.4 to 1 with respect to the total length R of the guide blade.

According to typical experiment results, in a range up to about r/R≈0.4 as the first inlet area A and the first outlet area a that are more adjacent to the center of axis, the blowing area of the air is relatively narrow and the centrifugal force is small. Then, this induces the lateral velocity component $U_s$ as the sum of the rotational velocity component $U_{th}$ and the radial velocity component $U_r$ in the axial direction. In a range from r/R≈0.4 as the second inlet area B and the second outlet area b, the centrifugal force acts in larger values as becoming farther away from the center of the axis, and thus the lateral velocity component $U_s$ spreads in both of the rotational and radial directions.

Figure 7:
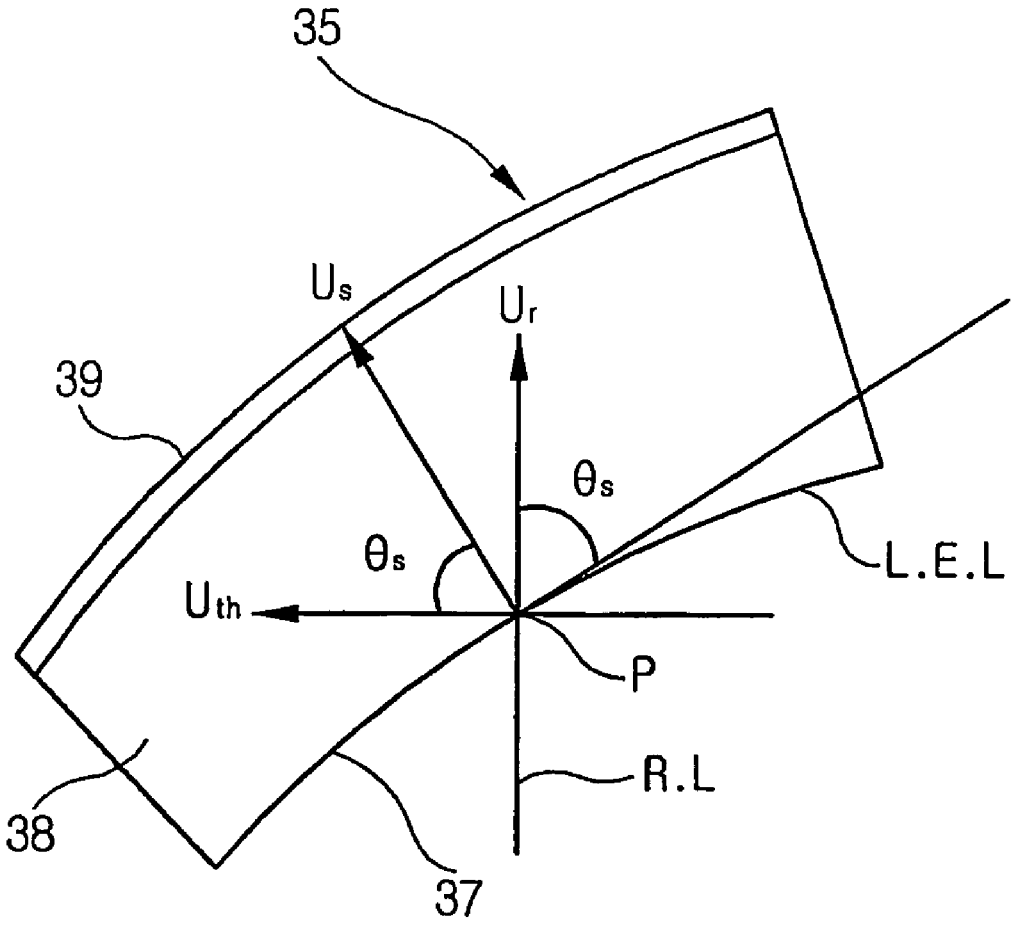
FIG. 7 illustrates an air flow structure of a guide blade seen from the rear in a direction perpendicular to an axial line A.L of FIG. 5.

FIG. 7 schematically illustrates an air flow structure of the guide blades taken along a line I—I of FIG. 5, seen in a rear view or from a direction perpendicular to the axial line A.L. In this structure, it is preferable to induce the lateral velocity component $U_s$ as the sum of the rotational velocity component $U_{th}$ and the radial velocity component $U_r$ in the axial direction to obtain the maximum efficiency.

The guide blade 35 maintains an angle perpendicular to the lateral velocity component $U_s$ so that its L.E.L can effectively receive the lateral flow of the air. Since the guide blade 35 is so curved that contact lines of the L.E.L at respective points of the guide blade 35 have an inclination angle θ, of the lateral velocity component $U_s$, wherein $\theta^s = \mathrm{Tan}^{-1}(U_r/U_{th})$, it has a changing curvature in which the center is curved in the rotational direction of the axial flow fan blade 12 when seen in general.

Now discussion will be made with respect to a plan sectional view which maximizes the blowing efficiency at a point P from the center of the axial flow fan in the range up to about r/R≈0.4 as the first inlet area A and the first outlet area a.

Figure 8:
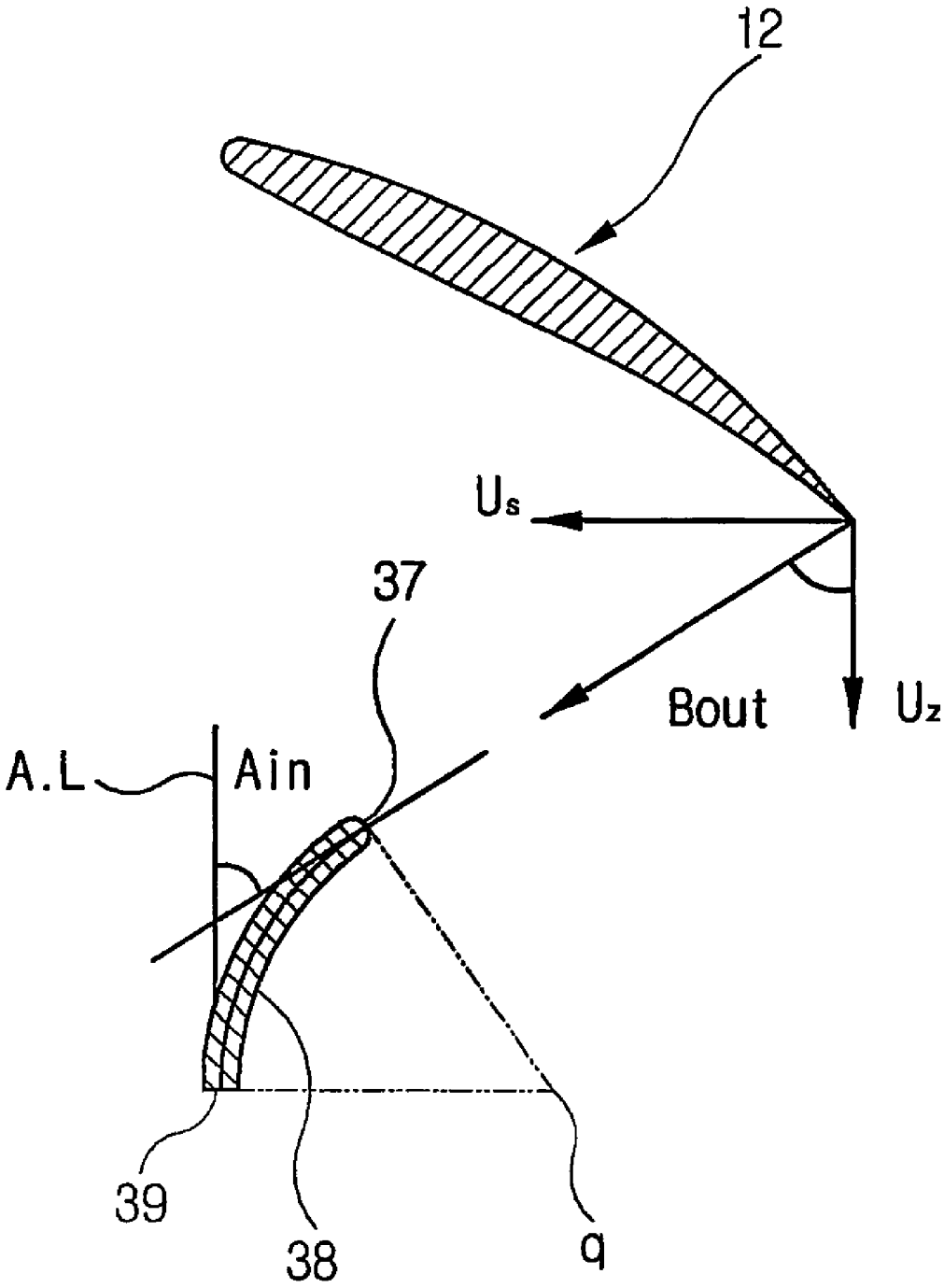
FIG. 8 is a schematic plan sectional view illustrating a guide blade taken along a line I—I in FIG. 5.

FIG. 8 schematically illustrates the plan view of the blade 12 and the guide blade 35 at a point P from the center of the axial flow fan taken along the line I—I of FIG. 5 for more detailed understanding of the configuration of the plan sectional view.

The air flow guide surface 38 of the guide blade 35 serves to axially refract the air having the lateral velocity component $U_s$ that is obliquely blown by the leading edge 37. In order that the blown air is introduced in parallel to the leading edge 37, the angle of incidence Ain is made the same as an angle of projection Bout of the blade 12 that is an angle of introduction of the blown air introduced to the leading edge (Ain=Bout). The angle of projection Aout is designed at 0° or parallel with the axial line A.L so that the air is blown in the axial direction. The air flow guide surface 38 is curved in the form of an arc to connect between the leading edge 37 and the trailing edge 39.

That is, the air flow guide surface 38 is so curved that the angle of incidence Ain becomes the same as an air inflow angle $\mathrm{Tan}^{-1}(U_s/U_z)$ in the first inlet area A and the angle of projection Aout becomes 0° with respect to the axial line in the first outlet area a.

As a consequence, in the leading edge 37 of the guide blade 35 at the point P spaced from the center of the axis taken along the line I—I, the air blown by the axial flow fan 10 is introduced in a direction inclined at the angle of projection Bout ($\mathrm{Tan}^{-1}(U_s/U_z)$) that is defined by the velocity vector U (i.e., a resultant vector of the lateral velocity component $U_s$ and the axial velocity component $U_z$) and the axial line A.L. Corresponding to the angle of projection Bout, the leading edge 37 of the guide blade 35 is obliquely set at the angle of incidence Ain with respect to the axial line, and the trailing edge 39 is set parallel with the axial line.

The air flow guide surface 38 between the leading edge 37 and the trailing edge 39 has the same radius as a circle which has a center at a point q intersected by normal lines of the leading and trailing edges 37 and 39 and a radius spaced from the point q to the leading edge 37 or the trailing edge 39. The curvature of the arc minimizes the vortex of the air to more smoothly refract the flow of the air along the air flow guide surface 38 and blow the air in the axial direction.

As described hereinbefore, in the range up to about r/R≈0.4 as the first inlet area A and the first outlet area a that are more adjacent to the center of axis which is less influenced by the centrifugal force, the guide blade 35 has a changing curvature structure in which the center is curved in the rotational direction of the axial flow fan blade 12 when seen in an axial direction and the air flow guide surface 38 is curved when seen in a plan sectional view so that the air blown by the axial flow fan 10 is introduced in parallel to the leading edge 37, refracted smoothly in the axial direction, and blown through the trailing edge 39.

Since the rotational velocity component $U_{th}$ and the radial velocity component $U_r$ being removed by the guide blade 35 and thus the air blown by the axial flow fan 10 is smoothly blown in the axial direction, the axial flow rate of the air is raised thereby remarkably enhancing the blowing efficiency of the axial flow fan 10.

In particular, in case of a pusher type axial flow fan 10 which is installed in front of the condenser, the blown air has a high transmissivity about heat dissipating fins of a heat exchanger to further enhance the blowing efficiency.

Now discussion will be made with respect to the configuration of a preferable guide blade 35 in the range from r/R≈0.4 as the second inlet area B and the second outlet area b in which the influence of contrary wind from the engine room as well as the blowing efficiency will be considered.

When taken along a line II—II in FIG. 5, it is necessary to induce most of the lateral velocity component $U_s$ as the sum of the rotational velocity component $U_{th}$ and the radial velocity component $U_r$ in the axial direction as well as spread the same in both of the rotational and radial directions.

Of course, the guide blade 35 has a changing curvature structure in which the center is curved in the rotational direction of the axial flow fan blade 12 when seen in an axial direction, substantially the same as that shown taken along the line I—I when seen in the axial direction, except for the configuration seen in a plan view.

Accordingly, discussion will be made with respect to a plan sectional view which maximizes the blowing efficiency at a point P from the center of the axial flow fan 10 in the range from about r/R≈0.4 to the tip.

Figure 9:
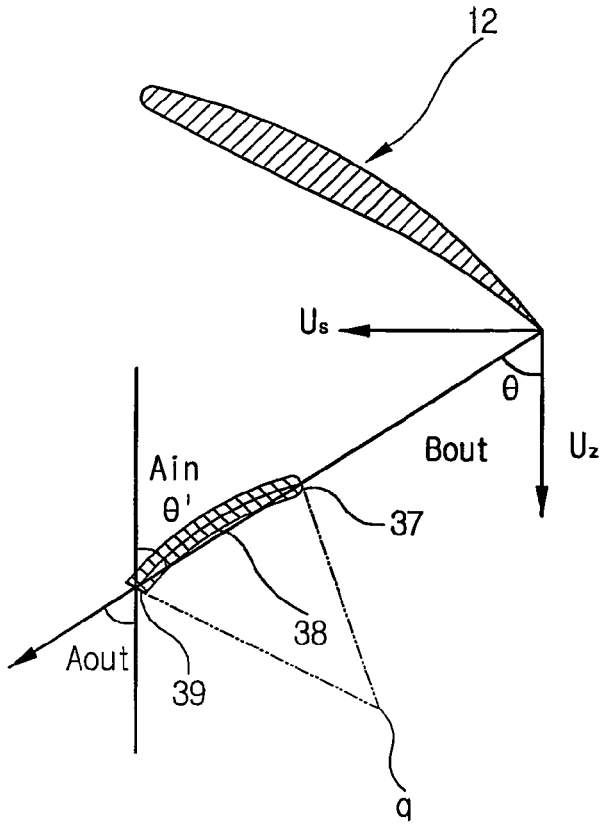
FIG. 9 is a schematic plan sectional view illustrating a guide blade taken along a line II—II in FIG. 5.

FIG. 9 is a schematic plan sectional view illustrating the blade 12 and the guide blade 35 at a point P from the center of the axial flow fan 10 taken along a line II—II in FIG. 5 in order to explain the configuration of the above plan sectional view.

The air flow guide surface 38 of the guide blade 35 serves to axially refract the air having a lateral velocity component Us that is introduced obliquely in an outer circumferential direction so that the air is introduced to the leading edge 37 at an angle slightly larger than the parallel angle. In this case, Ain (θ') is made larger than Bout (θ), in which θ'>θ. The angle of incidence Ain is formed larger than the angle of projection Bout of the air by the blade 12, that is, the inflow angle of the air that is introduced to the leading edge 37. The angle of projection Aout is formed at an angle θ so that the blown air has a lateral component. That is, the angle of projection Aout is formed to have an inclination oblique with respect to the axial line A.L.

The guide blade 35 is curved into an arc of a large curvature between the leading edge 37 and the trailing edge 39.

As a consequence, in the leading edge 37 of the guide blade 35 at the point P spaced from the center of the axis taken along the line II—II, the air blown by the axial flow fan 10 is introduced in a direction inclined at the angle of projection Bout ($\mathrm{Tan}^{-1}$ ($U_s/U_z$)) that is defined by the velocity vector U (i.e., a resultant vector of the lateral velocity component $U_s$ and the axial velocity component $U_z$) and the axial line A.L. Corresponding to the angle of projection Bout, the leading edge 37 of the guide blade 35 is obliquely set at the angle of incidence Ain (θ') with respect to the axial line, and the trailing edge 39 is set parallel with the axial line.

The air flow guide surface 38 between the leading edge 37 and the trailing edge 39 has the same radius as a circle which has a center at a point q intersected by normal lines of the leading and trailing edges 37 and 39 and a radius spaced from the point q to the leading edge 37 or the trailing edge 39. The curvature of the arc has a small curvature in the vicinity of r/R≈0.4 but increases as approaching the tip up to a substantially unlimited value.

Figure 10:
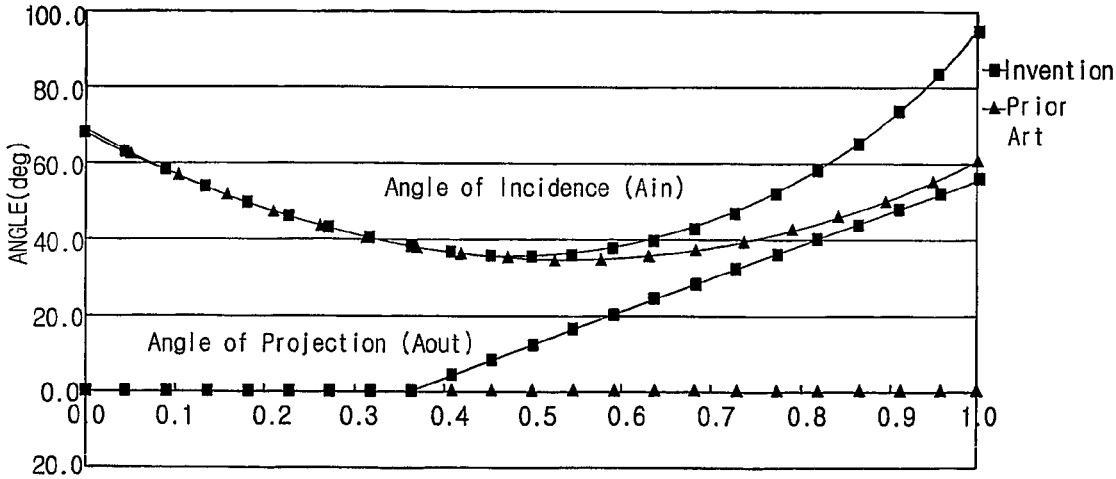
FIG. 10 is a graph for comparing design factors of angles of incidence and projection about a guide blade radius ratio r/R of the present invention with those of the prior art.

FIG. 10 is a graph for comparing design factors of the angle of incidence and the angle of projection about the guide blade radius ratio r/R of the present invention with those of the prior art.

As shown in FIG. 10, the angle of projection Aout of the prior art is maintained 0° to be parallel with the axial line. However, it is apparent that the angle of projection Aout of the present invention increases gradually up to about 0 to 60° with respect to the axial line up to 0.4 to 1 of the radial ratio r/R in the second outlet area b of the guide blade 35.

It is also observed that the angle of incidence Ain of the prior art is gradually increased up to the radial ratio r/R of the guide blade 0.5 to 1 with respect to the axial line to have about 60° at the tip. However, the angle of incidence Ain of the present invention is gradually increased more sharply than in the prior art up to 0.4 to 1 of the radial ratio r/R with respect to the axial line in the second inlet area B of the guide blade 35 and reaches substantially 90° at the tip where the radius ratio r/R is substantially 1.

In the vicinity of the tip of the guide blade 35 corresponding to r/R≈1, the angle of incidence is substantially 90° and the angle of projection is substantially 60°.

As set forth above, in proportion to the increase of the ratio r/R, in the range from r/R>0.4 to r/R≈1 where the influence of the centrifugal force becomes larger as becoming farther away from the center of the axis, the structure of the guide blade 35 has a changing curvature in which the center is curved in the rotational direction of the axial flow fan blade 12 when seen in the axial direction. When seen in a plan view, the guide blade 35 has a curved structure in which the inclination of the air flow guide surface 38 gradually increases, and the angle of incidence Ain and the angle of projection Aout gradually increase.

Accordingly, in the air blown by the axial flow fan 10, the axial flow component gradually decreases and the lateral component gradually increases while the air is introduced parallel with the leading edge 37 in the vicinity of r/R≈0.4, smoothly axially refracted along the air flow guide surface 38. As approaching the tip, most of the air flows as spread in the rotational and radial directions so that the air can flow bypassing the engine in the rear of the axial flow fan 10 without collision into the engine in order to prevent high temperature heat generated by the engine from flowing back to the heat exchanger.

As described hereinbefore, while it has been described in the present invention that the guide blade 35 is formed integrally with the motor support ring 32 and the housing 31, the present invention is not limited thereto, but the guide blade 35 can be manufactured separately and then additionally coupled with the motor support ring 32 and the housing 31.

INDUSTRIAL APPLICABILITY

As set forth above, the guide blade of the shroud of the present invention is so designed that the angles of incidence and projection increase gradually up to 0.4 to 1 of the radial ratio $r_b$/R to raise the blowing efficiency while preventing high temperature heat generated by the engine from flowing back to the heat exchanger thereby improving the performance of an air conditioning system.

What is claimed is:

1. A guide blade of an axial flow fan shroud comprising:

a leading edge for introducing the air blown by an axial flow fan including a plurality of blades;

a trailing edge extended from the leading edge to downstream; and an air flow guide surface for guiding the blown air between the leading and trailing edges, wherein the area from a root to a radius ($r_a$) is defined as the first outlet area (a);

the area from a radius ($r_a$) to the radius (R) which is the total length of the guide blade is defined as the second outlet area (b);

the angle between the tangent line at the trailing edge and the axis of the axial flow fan is defined as the angle of projection (Aout); and wherein the angle of projection (Aout) increases as approaching a tip with respect to an axial line in the second outlet area (b).

2. The guide blade of an axial flow fan shroud according to claim 1, wherein the second outlet area (b) has a radial ratio ($r_a$/R) in the range of about 0.4 to 1 with respect to the total length (R) of the guide blade.

3. The guide blade of an axial flow fan shroud according to claim 1, wherein the area from a root to a radius ($r_b$) is defined as the first inlet area (A);

the area from the radius ($r_b$) to the radius (R) which is the total length of the guide blade is defined as the second inlet area (B);

the angle between the tangent line at the leading edge and the axis of the axial flow fan is defined as the angle of incidence (AIN); and wherein the second inlet area (B) has a radial ratio ($r_b$/R) in the range of about 0.4 to 1 with respect to the total length (R) of the guide blade, and the angle of incidence (AIN) gradually increases up to about 90° in the second inlet area (B).

4. The guide blade of an axial flow fan shroud according to claim 3, wherein (Us) is a lateral velocity vector of air at a point (P), and (Uz) is the axial velocity of component of air at the point (P), and the air flow guide surface is so curved that the angle of incidence (Ain) is the same as an air inflow angle $Tan^{-1}(Us/Uz)$ in the first inlet area (A), and the angle of projection (Aout) is 0° with respect to the axial line.

5. The guide blade of an axial flow fan shroud according to claim 3, further comprising an auxiliary ring formed by a radius ($r_c$) from the root of the total length (R) of the guide blade, wherein the auxiliary ring partitions the first and second inlet areas (A) and (B) and the first and second outlet areas (a) and (b).

* * * * *